United States Patent [19]

MacKinnon

[11] Patent Number: 5,035,824

[45] Date of Patent: Jul. 30, 1991

[54] STREAMING POTENTIAL INHIBITOR FOR HYDRAULIC FLUIDS

[75] Inventor: Hugh S/ MacKinnon, Hercules, Calif.

[73] Assignee: Chevron Research Company, San Francisco, Calif.

[21] Appl. No.: 511,494

[22] Filed: Apr. 20, 1990

Related U.S. Application Data

[63] Continuation of Ser. No. 329,743, Mar. 28, 1989, abandoned, which is a continuation of Ser. No. 158,178, Feb. 19, 1988, abandoned, which is a continuation of Ser. No. 68,075, Jan. 30, 1987, abandoned.

[51] Int. Cl.[5] ..... C10M 135/10; C10M 105/74

[52] U.S. Cl. ..... 252/75; 252/33; 252/33.4; 252/33.6; 252/49.8; 252/78.1; 252/78.5

[58] Field of Search ..... 252/33, 33.4, 33.6, 252/49.8, 75, 78.1, 78.5

[56] References Cited

U.S. PATENT DOCUMENTS

| | | | |
|---|---|---|---|
| 3,352,780 | 11/1967 | Groslambert | 252/78.5 |
| 3,649,721 | 3/1972 | Burrous | 252/75 |
| 3,907,697 | 9/1975 | Burrous | 252/75 |
| 4,087,386 | 5/1978 | Dounchis | 252/49.8 |
| 4,206,067 | 6/1980 | MacKinnon | 252/75 |
| 4,302,346 | 11/1981 | MacKinnon | 252/75 |

*Primary Examiner*—Paul Lieberman
*Assistant Examiner*—J. Darland
*Attorney, Agent, or Firm*—R. C. Gaffney; J. J. DeYoung

[57] ABSTRACT

An erosion-inhibited phosphate ester-based functional fluid comprising a major amount of a phosphate ester and from 10 to 50,000 parts per million by weight of a calcium salt of an organic sulfonate, said functional fluid having been heated to a temperature and for a time sufficient to increase the conductivity of said fluid to at least 0.3$\mu$ mho/cm.

9 Claims, No Drawings

STREAMING POTENTIAL INHIBITOR FOR HYDRAULIC FLUIDS

BACKGROUND OF THE INVENTION

1. Field of the Invention

This invention relates to fluid compositions which are useful for transmitting power in hydraulic systems Specifically, it relates to power transmission fluids having a tendency to cause erosion of hydraulic systems and a newly discovered means of controlling such erosion.

Organic phosphate ester fluids have been recognized for some time as advantageous for use as the power transmission medium in hydraulic systems. Such systems include recoil mechanisms, fluid-drive power transmissions, and aircraft hydraulic systems. In the latter, phosphate ester fluids find particular utility because of their special properties which include high viscosity index, lower pour point, high lubricity, low toxicity, low density and low flammability. Thus, for some years, numerous types of aircraft, particularly commercial jet aircraft, have used phosphate ester fluids in their hydraulic systems. Other power transmission fluid which have been utilized include major or minor amounts of hydrocarbon oils, amides of phosphoric acid, silicate esters, silicones and polyphenyl ethers. Additives which perform special functions such as viscosity index improvement and foam inhibition are also present in these fluids.

The hydraulic systems of a typical modern aircraft contain a fluid reservoir, fluid lines and numerous hydraulic valves which actuate various moving parts of the aircraft such as the wing flaps, ailerons, rudder and landing gear. In order to function as precise control mechanisms, these valves often contain passages or orifices having clearances on the order of a few thousandths of an inch or less through which the hydraulic fluid must pass. In a number of instances, valve orifices have been found to be substantially eroded by the flow of hydraulic fluid. Erosion increases the size of the passage and reduces below tolerable limits the ability of the valve to serve as a precision control device. Many aircraft have experienced sagging wing flaps during landings and takeoffs as a result of valve erosion.

Early investigations indicated that the erosion was being caused by cavitation in the fluid as the fluid passed at high velocity from the high-pressure to the low-pressure side of the valve. The incorporation of water into the hydraulic fluid was found to inhibit the erosion, but continuing experience shows that a significant erosion problem remains.

Recent studies indicate that certain valve erosions are associated with the electrokinetic streaming current induced by the high-velocity fluid flow.

2. Description of the Prior Art

A study of the problem attributing valve erosion to the streaming current induced by fluid flow is Beck et al., "Corrosion of Servovalves by an Electrokinetic Streaming Current", Boeing Scientific Research Document D1-82-0839 (September, 1969) and Beck et al., "Wear of Small Orifice by Streaming Current Driven Corrosion", Transactions of the ASME, Journal of Basic Engineering, pages 782–791 (December, 1970). Efforts to control hydraulic valve erosion by treating the problem as one of cavitation in the fluid are described in Hampton, "The Problem of Cavitation Erosion in Aircraft Hydraulic Systems", Aircraft Engineering, XXXVIII, No. 12 (December, 1966). The text, Organophosphorous Compounds, by Kosolapoff (Wiley, N.Y., 1950), describes methods for preparing organophosphorous derivatives. Several patents describe phosphate ester hydraulic fluids, including U.S. Pat. Nos. 2,636,861; 2,636,862; 2,894,911; 2,903,428; 3,036,012; 3,649,721; 3,679,587; 3,790,487; and 3,907,697.

U.S. Pat. No. 3,352,780 teaches the use of alkaline earth metal sulfonates in phosphate ester-based hydraulic fluids.

SUMMARY OF THE INVENTION

An erosion-inhibited phosphate ester-based functional fluid comprising a major amount of a phosphate ester and from 10 to 50,000 parts per million by weight of a calcium salt of an organic sulfonate, said functional fluid having been heated to a temperature for a time sufficient to increase the conductivity of said fluid to at least 0.3$\mu$ mho/cm.

DETAILED DESCRIPTION OF THE INVENTION

Now I have discovered that the calcium salts of organic sulfonates inhibit the formation of streaming potential in phosphate ester hydraulic fluids, provided that the ester-sulfonate mixture is heated before use as a hydraulic fluid. Among other things, this invention is based on my discovery that heating a phosphate ester hydraulic fluid containing the calcium sulfonate gave improved inhibition of streaming potential formation in excess of that provided by other streaming potential inhibitors.

Fluid Base

The power transmission fluid of the present invention comprises a fluid base present in major proportion in which the calcium sulfonate and other additives are contained. The fluid base in which the additives of this invention are employed include a wide variety of base materials, such as organic esters of phosphorus acids, mineral oils, synthetic hydrocarbon oils, silicate esters, silicones, carboxylic acid esters, aromatic hydrocarbons and aromatic halides, esters of polyhydric material, aromatic ethers, thioethers, etc.

The phosphate esters which are the preferred base fluid of the present invention have the formula:

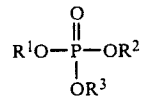

wherein $R^1$, $R^2$ and $R^3$ each represent an alkyl or aryl hydrocarbon group. (As used herein, "aryl" includes aryl, alkaryl, and aralkyl structures and "alkyl" includes aliphatic and alicyclic structures.) All three groups may be the same, or all three different, or two groups may be alike and the third different. A typical fluid will contain at least one species of phosphate ester and usually will be a mixture of two or more species of phosphate esters.

The phosphate esters will each have a total carbon content of 3 to 36 carbon atoms. Individual alkyl groups will usually have 1 to 12 carbon atoms, while individual aryl groups will usually have 6 to 12 carbon atoms. Preferred esters contain 12 to 24 total carbon atoms, preferably, alkyl groups, 4 to 6 carbon atoms, and preferred aryl groups, 6 to 9 carbon atoms. The alkyl groups may be straight- or branched-chain, with straight-chain, such as n-butyl, preferred. Similarly, the alkyl substituents in alkylaryl structures may also be straightor branched-chain. Generic examples of the phosphate esters include trialkyl phosphates, triaryl phosphates and mixed alkylaryl phosphates. Specific examples include trimethyl phosphate, tributyl phosphate, dibutyloctyl phosphate, triphenyl phosphate, phenyl dicresyl phosphate, ethyl diphenyl phosphate, isopropyl diphenyl phosphate, diisopropyl phenyl phosphate, dibutylphenyl phosphate, tricresyl phosphate, etc.

In practice, phosphate ester fluid base generally contains several phosphate esters mixed together. Usually, one particular ester or several closely related esters will predominate. In a preferred type of fluid, the phosphate ester portion contains only trialkyl and triaryl phosphate esters, with the trialkyl phosphate esters predominating. Typically, the phosphate ester portion of this fluid will consist of 70–99 weight percent, preferably, 80–92 weight percent trialkyl phosphate esters, with the remainder triaryl phosphate esters. The phosphate ester portion is normally 75–95 weight percent of the total fluid and preferably, 85–95 weight percent.

The Calcium Sulfonates

The sulfonates useful in this invention are the calcium salts of those sulfonates usually considered as aqueous detergents. Such sulfonates include the olefin sulfonates, the alkylaryl sulfonates, the paraffin sulfonates, and similar compounds. The alkylaryl sulfonates are the preferred materials for this invention. The alkylaryl sulfonates may be made by sulfonating natural mixtures of aromatic compounds such as crude oil, naphtha, etc., or they may be made synthetically by sulfonating the reaction product of an olefin, alkyl halide, or alkanol with an aromatic compound. These sulfonates have alkyl groups of 8 to 28 carbons attached to aryl groups such as benzene, toluene, naphthalene, and the like. The preferred sulfonate is calcium dinonylnaphthalene sulfonate. This compound is commercially available from Vanderbilt as Nasul 729. It has been surprisingly found that the barium, zinc, and ethylene diamine salts are ineffective.

Heating of the Mixture

Heating the calcium sulfonate/phosphate ester mixture is essential for the production of a mixture having good streaming potential inhibition. The heating is done at a temperature and for a time sufficient to increase the conductivity of the fluid to at least 0.3$\mu$ mho/cm. Generally the heating must be in excess of 140° F. and in the range of 140°–250° F., and more preferably from 180°–225° F. Generally the heating should be continued for 1–20 hours, preferably for 2–4 hours to obtain the increase in conductivity to 0.3$\mu$ mho/cm. The preferred mode of operation is to heat the mixture for 3 hours at 225° F. Heating for long times at low temperatures is generally not practical.

The amount of calcium sulfonate inhibitor ranges from 0.1–10%, preferably from 0.5–2%, based on total weight of the mixture.

Other Additives

The power transmission fluids of the present invention generally contain a number of additives which in total comprise 5–25 weight percent of the finished fluid. Among these is water, which may be added or often becomes incorporated into the fluid unintentionally. Such incorporation can occur when a hydraulic system is being refilled and is open to the atmosphere, particularly in humid environments. Unintentional incorporation of water may also occur during the manufacturing process of a phosphate fluid. In practice, it is recognized that water will be incorporated into the fluid and steps are taken to control the water content at a level in the range of 0.1–1 weight percent of the whole fluid. It is preferred that the water content be in the range of 0.1–0.8 weight percent and more preferably, 0.2–0.6 weight percent.

Preferred additional additives are perfluorinated surfactants such as are disclosed in U.S. Pat. Nos. 4,324,674 and 3,679,587, the entire disclosures of which are incorporated herein by reference.

Hydrolysis inhibitors to retard corrosion are often added to hydraulic fluids. They include various epoxides such as the glycidyl ethers described in U.S. Pat. No. 2,636,861. Typical epoxide compounds which may be used include glycidyl methyl ether, glycidyl isopropyl ether, styrene oxide, ethylene oxide, and epichlorohydrin. Hydrocarbon sulfides, especially hydrocarbon disulfides, such as dialkyl disulfide, are often used in combination with the epoxide compounds for additional corrosion suppression. Typical hydrocarbon disulfides include benzyl disulfide, butyl disulfide and diisoamyl disulfide. A particularly preferred class of epoxide hydrolysis inhibitors are those containing two linked cyclohexane groups to each of which is fused an epoxide (oxirane) group. Illustrative are those in which the linking structure contains a carboxylic acid ester group or a dioxane ring.

The hydraulic fluid normally contains 2–10 weight percent, preferably 5–10 weight percent, of one or more viscosity index improving agents such as alkyl styrene polymers, polymerized organic silicones, or preferably, polyisobutylene, or the polymerized alkyl esters of the acrylic acid series, particularly acrylic and methacrylic acid esters. These polymeric materials generally have a number average molecular weight of from about 2,000 to 300,000.

Measurements

It has been found that the rate of valve erosion in aircraft hydraulic system valves varies with the electrical streaming potential of the hydraulic fluid passing through the valve. Streaming potential is defined on pages 4–30 of the Electrical Engineers Handbook, by Pender and Del Mar (New Yori, Wiley, 1949). It is the EMF created when a liquid is forced by pressure through an orifice and is a function of factors such as the electrical properties and viscosity of the liquid, the applied pressure, and the physical characteristics of the orifice. Since the streaming potential is dependent on several factors, it is found that the streaming potential measurement of a given fluid on a given apparatus at a given time will vary over a small range. For this reason, the ordinary practice is to select as a standard a fluid which is considered to have acceptable erosive characteristics. Each day the apparatus is calibrated by measuring the streaming potential of the standard fluid and then comparing the streaming potential of the test fluids against this standard. The apparatus used to measure streaming potential is described in detail in the Beck et al. report "Wear of Small Orifices by Streaming Current Driven Corrosion", referred to above. Measurements are taken at room temperature with the fluid pressure adjusted to 800 psi. For convenience, the streaming potential detected by the apparatus is impressed across a standard 100,000-ohm resistor to obtain a resultant current, which is reported as the "streaming current" or "wall current".

EXAMPLES

The following examples illustrate the effectiveness of various additives in controlling the conductivity and wall current of a functional fluid. Conductivities in excess of $0.3\times10^{-6}$ mho/cm are considered satisfactory with conductivities in the range of 0.3 to $1.3\times10^{-6}$ mho/cm being preferred. Wall currents of less than 0.15 microamperes are considered satisfactory with wall currents less than 0.10 microamperes being preferred.

The hydraulic fluid used in the following examples is the Society of Automotive Engineers (SAE) reference phosphate fluid SAE-1 (manufactured by Monsanto). This fluid is known to cause damage in servo valves. The calcium sulfonate additive is calcium dinonylnaphthalene sulfonate which was purchased from R. T. Vanderbilt Company, Inc., 230 Park Avenue, New York, N.Y. (Trade name Nasul 729).

In test No. 1 about one liter of SAE-1 phosphate ester reference fluid was filtered through a 1 micro millipore and the conductivity and wall current were measured. In test No. 2 10.00 grams of Nasul 727 (1.00%) was added to 990.00 grams of SAE-1 phosphate ester reference fluid and stirred at room temperature until dissolved. This solution was filtered through a 1 micro millipore and the conductivity was measured.

For test No. 3, the solution of test No. 2 was placed in a stoppered flask which was then stored in an oven at 225° F.±4° F. for 3.0 hours. The solution was then cooled to room temperature yielding a clear bright solution. The conductivity and wall current were measured. The results are shown in Table I below.

Comparison of test Nos. 1, 2 and 3 indicates that surprisingly the conductivity of the test fluid was dramatically increased by heating the fluid.

What is claimed is:

1. An erosion-inhibited phosphate ester-based functional fluid comprising a major amount of a phosphate ester and from 10 to 50,000 parts per million by weight of calcium salt of an organic sulfonate, said functional fluid having been heated to a temperature and for a time sufficient to increase the conductivity of said fluid to at least 0.3μ mho/cm.

2. The composition of claim 1 wherein said heating is done at a temperature in the range of 140°-250° F. for 1-20 hours.

3. The composition of claim 1 wherein said heating is done at a temperature in the range of 180°-225° F. for 2-4 hours.

4. The compositions of claim 1 wherein the phosphate ester is a mixed alkylaryl phosphate.

5. The composition of claim 4 wherein the phosphate ester is a mixture of trialkyl phosphate and triaryl phosphate.

6. The composition of claim 5 wherein the trialkyl phosphate is tributyl phosphate and the triaryl phosphate is triscresyl phosphate or triisopropylphenyl phosphate.

7. The composition of claim 1, 3 or 5 wherein said fluid contains 200 to 5,000 parts per million of said organic sulfonate and said sulfonate is an alkylaryl sulfonate.

8. The composition of claim 1, 3 or 5 wherein said organic sulfonate is dinonylnaphthalene sulfonate.

9. A method of operating a hydraulic device wherein a displacing force is transmitted to a displacing member by means of a functional fluid, the improvement which comprises employing as said fluid the composition of claim 1, 3 or 5.

* * * * *

TABLE I

| Test No. | Sulfonate Additive | Concentration wt % | Heating of the Mixture Temperature, °F. | Heating of the Mixture Time | Conductivity (mho/cm)$10^{-6}$ | Wall Current amps($10^{-6}$) |
|---|---|---|---|---|---|---|
| 1 | — | None | None | — | 0.02 | 0.36 |
| 2 | Nasul 729[1] | 1.00 | Room Temp. | — | 0.21 | — |
| 3 | Nasul 729[1] | 1.00 | 225° F. ± 4° F. | 3.0 hrs. | 0.51 | 0.13 |

[1]Nasul 729